US006321737B1

(12) United States Patent
Johnson et al.

(10) Patent No.: US 6,321,737 B1
(45) Date of Patent: Nov. 27, 2001

(54) TOY ROCKET LAUNCHER

(75) Inventors: Lonnie G. Johnson, Atlanta; John T. Applewhite, Smyrna; Jeffrey Shane Matthews, Atlanta, all of GA (US)

(73) Assignee: Johnson Research & Development Co., Inc., Smyrna, GA (US)

( * ) Notice: Subject to any disclaimer, the term of this patent is extended or adjusted under 35 U.S.C. 154(b) by 0 days.

(21) Appl. No.: 09/448,747

(22) Filed: Nov. 24, 1999

(51) Int. Cl.[7] ..... F41B 11/00
(52) U.S. Cl. ..... 124/73; 124/56; 124/75
(58) Field of Search ..... 124/56, 63, 69, 124/70, 73, 75; 446/56, 211

(56) References Cited

U.S. PATENT DOCUMENTS

| | | | |
|---|---|---|---|
| 1,713,432 | 5/1929 | Griggs . | |
| 2,023,124 | 12/1935 | Dickover | 46/86 |
| 2,147,003 | 2/1939 | Von Kozurik | 124/11 |
| 2,312,244 | 2/1943 | Feltman | 124/11 |
| 2,357,951 | 9/1944 | Hale | 124/11 |
| 2,409,653 | 10/1946 | Amdur | 124/11 |
| 2,505,428 | 4/1950 | Pope | 124/11 |
| 2,654,973 | 10/1953 | Lemelson | 46/56 |
| 2,733,699 | 2/1956 | Krinsky | 124/13 |
| 2,927,398 | 3/1960 | Kaye et al. | 46/74 |
| 3,025,633 | 3/1962 | Kaye et al. | 46/74 |
| 3,049,832 | 8/1962 | Joffe | 46/74 |
| 3,121,292 | 2/1964 | Butler et al. | 46/74 |
| 3,218,755 | 11/1965 | Quercetti | 46/86 |
| 3,308,803 | 3/1967 | Walther | 124/13 |
| 3,397,476 | 8/1968 | Weber | 43/6 |
| 3,415,010 | 12/1968 | Belz | 46/241 |
| 3,510,980 | 5/1970 | Pippin, Jr. | 46/74 |
| 3,878,827 | 4/1975 | Newgarde, Jr. | 124/1 |
| 3,943,656 | 3/1976 | Green | 46/74 |
| 3,962,818 | 6/1976 | Pippin | 46/74 |
| 4,004,566 | 1/1977 | Fischer | 124/11 |
| 4,073,280 | 2/1978 | Koehn | 124/72 |
| 4,083,349 | 4/1978 | Clifford | 124/72 |
| 4,159,705 | 7/1979 | Jacoby | 124/63 |
| 4,223,472 | 9/1980 | Feket et al. | 46/44 |
| 4,411,249 | 10/1983 | Fogarty et al. | 124/64 |
| 4,466,213 | 8/1984 | Alberico et al. | 446/56 |
| 4,687,455 | 8/1987 | Sculatti | 446/52 |
| 4,819,609 | 4/1989 | Tippmann | 124/72 |
| 4,848,307 | 7/1989 | Tsao | 124/59 |
| 4,890,767 | 1/1990 | Burlison | 222/78 |
| 4,897,065 | 1/1990 | Fertig et al. | 446/63 |
| 4,928,661 | 5/1990 | Bordt et al. | 124/61 |
| 4,955,512 | 9/1990 | Sharples | 222/386.5 |
| 5,090,708 | 2/1992 | Gerlitz et al. | 273/310 |
| 5,097,816 | 3/1992 | Miller | 124/49 |
| 5,097,985 | 3/1992 | Jones | 221/86 |
| 5,188,557 | 2/1993 | Brown | 446/212 |
| 5,229,531 | 7/1993 | Song | 42/58 |

(List continued on next page.)

FOREIGN PATENT DOCUMENTS

2587911-A1 10/1985 (FR) .

*Primary Examiner*—Charles T. Jordan
*Assistant Examiner*—Kevin Jakel
(74) *Attorney, Agent, or Firm*—Baker, Donelson, Bearman & Caldwell

(57) ABSTRACT

A rocket launcher (10) is provided having a manual air pump (11) coupled to a base unit (12) through an elongated pressure tube (13) having a pressure release valve or trigger (20). The base unit has a pressure chamber (24), a launch tube (25), and an orientation sensitive safety mechanism (32) coupled to the end of the pressure tube. The safety mechanism is coupled to an internal pressure tube (33) which extends to a pressure sensitive release valve (34) that controls the release of pressurized air from the launch tube. The orientation sensitive safety mechanism prevents the launching of projectiles should the launch tube be offset from a vertical orientation and depressurizes the launcher should an operator attempt to fire the launcher while in an offset orientation.

14 Claims, 3 Drawing Sheets

U.S. PATENT DOCUMENTS

| | | | | |
|---|---|---|---|---|
| 5,280,778 | | 1/1994 | Kotsiopoulos | 124/73 |
| 5,280,917 | | 1/1994 | Ortiz | 273/318 |
| 5,339,791 | | 8/1994 | Sullivan | 124/73 |
| 5,343,849 | | 9/1994 | Steer | 124/72 |
| 5,343,850 | | 9/1994 | Steer | 124/64 |
| 5,349,938 | | 9/1994 | Farrell | 124/73 |
| 5,370,278 | | 12/1994 | Raynie | 222/175 |
| 5,373,832 | | 12/1994 | D'Andrade | 124/69 |
| 5,381,778 | * | 1/1995 | D'Andrade | 124/69 |
| 5,413,514 | | 5/1995 | Milligan | 446/36 |
| 5,415,152 | | 5/1995 | Adamson et al. | 124/59 |
| 5,415,153 | * | 5/1995 | Johnson et al. | 124/63 |
| 5,450,839 | | 9/1995 | Nicolaevich et al. | 124/73 |
| 5,471,968 | | 12/1995 | Lee | 124/64 |
| 5,497,758 | | 3/1996 | Dobbins et al. | 124/73 |
| 5,515,837 | | 5/1996 | Nin et al. | 124/59 |
| 5,529,050 | | 6/1996 | D'Andrade | 124/56 |
| 5,538,453 | * | 7/1996 | Johnson | 446/176 |
| 5,553,598 | | 9/1996 | Johnson et al. | 124/63 |
| 5,605,140 | | 2/1997 | Griffin | 124/59 |
| 5,613,483 | | 3/1997 | Lukas et al. | 124/73 |
| 5,653,216 | * | 8/1997 | Johnson | 124/69 |
| 5,673,679 | | 10/1997 | Walters | 124/53.5 |
| 5,701,879 | | 12/1997 | Johnson et al. | 124/69 |
| 5,704,342 | | 1/1998 | Gibson et al. | 124/73 |
| 5,722,383 | | 3/1998 | Tippman, Sr. et al. | 124/76 |
| 5,769,066 | | 6/1998 | Schneider | 124/75 |
| 5,771,875 | | 6/1998 | Sullivan | 124/72 |
| 5,794,606 | | 8/1998 | Deak | 124/51.1 |
| 5,816,232 | | 10/1998 | Bell | 124/51.1 |
| 5,819,717 | * | 10/1998 | Johnson et al. | 124/65 |
| 5,878,734 | | 3/1999 | Johnson et al. | 124/59 |
| 5,881,706 | * | 3/1999 | Carson | 124/69 |

* cited by examiner

TOY ROCKET LAUNCHER

TECHNICAL FIELD OF THE INVENTION

The present invention relates generally to toy rocket launchers and more particular to toy and model rocket launchers which utilize compressed air to propel a rocket.

BACKGROUND OF THE INVENTION

For decades, toy rockets have been popular playthings for children of all ages. Such rockets have been made available in all shapes and sizes and many models have been provided with their own propellant. Most toy rockets that have been the playthings of children are designed to be launched by one of various means into the air for flight.

One method of launching rockets has been with the use of solid fuel rocket engines. These solid fuel rocket engines provide ample thrust to launch a rocket several hundred feet into the air. However, there are many dangers involved with the use of solid fuel engines. For instance, once the engine is ignited its burn can not be stopped until the entire fuel supply of the engine has been utilized. Another danger associated with these rockets is that they may be launched in any orientation. As such, if a rocket tips over prior to launch or is even purposely directed in a direction other than vertical, the rocket nevertheless will be launched. Such a misdirected launching poses an extremely dangerous situation to both property and spectators.

Rockets have also been designed to include a pressure tank in which pressurized air or water is stored and expelled through a nozzle in order to propel the rocket, as shown in U.S. Pat. No. 5,415,153. However, once these rockets are fully pressurized they cannot be removed from the launcher without firing the rocket. Many of these types of rockets do not include safety mechanisms which prevent the rocket from firing should it be oriented in a position other than vertical. As such, many of these rockets may be accidentally or purposely fired at people or property.

Another popular method of launching toy rockets has been with a launcher which utilizes compressed air behind the rocket to propel it forward, as shown in U.S. Pat. No. 5,653,216. While these rockets do not utilize dangerous solid fuel burning engines, they still have the problem of being capable of being launched in a non-vertical orientation.

Recently, rockets have been designed to incorporate a safety mechanism to ensure the rocket is oriented vertically during launch, as shown in U.S. Pat. No. 5,414,153. Here, a pneumatic latch prevents the release of the rocket from the launcher if the rocket is off-set from a generally vertical orientation. While this aids is preventing the launching of a mis-oriented rocket such does not render the rocket harmless. It should be noted the rocket described herein remains pressurized and ready to launch. As such, if a child manually disengages the rocket, the compressed air will still be discharged and the rocket will be launched.

Accordingly, it is seen that a need remains for a rocket which may deploy only in a vertical orientation and rendered harmless should an attempt be made to fire the rocket in a mis-oriented position. It is to the provision of such therefore that the present invention is primarily directed.

SUMMARY OF THE INVENTION

In a preferred form of the invention a rocket launcher comprises an air pump for providing a supply of pressurized air, a pressure cell in fluid communication with the pump through conduit means, and a launch tube in fluid communication with the pressure cell through a first pressure sensitive release valve. The conduit means has a first conduit extending between the pump and the first pressure sensitive release valve and a second conduit in fluid communication with the first conduit and the pressure cell. The second conduit has an orientation sensitive check valve means for preventing the flow of air from the pressure cell to the first conduit when the launch tube is oriented in a generally vertical position and for allowing the flow of air from the pressure cell to the first conduit when the launch tube is offset from a generally vertical position. The launcher also has a pressure release valve coupled to the first conduit. With this construction and with the launch tube in a generally vertical position, the orientation sensitive check valve means prevents air from flowing from the pressure cell into the first conduit with the actuation of the pressure release valve, thereby causing the actuation of the first pressure sensitive release valve and the release of pressurized air into the launch tube, and with the launch tube in an offset position the orientation sensitive check valve means allows the flow of air from the pressure cell into the first conduit means with the actuation of the pressure release valve thereby decompressing the pressure cell and preventing the release of pressurized air into the launch tube.

DETAILED DESCRIPTION

Figure 1:
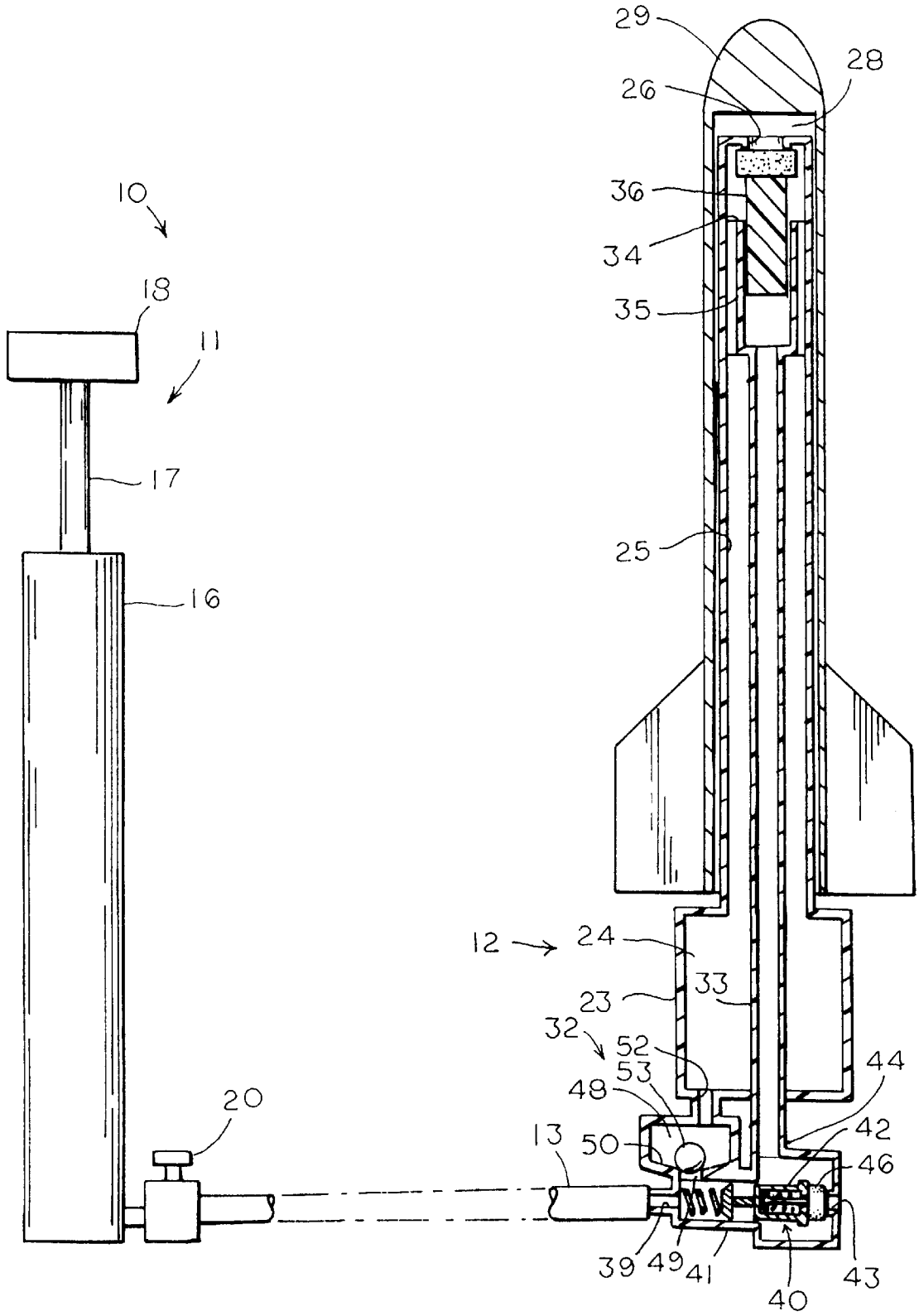
FIG. 1 is a side view shown in partial cross-section of a rocket launcher and toy rocket embodying principals of the present invention in a preferred form.

With reference next to the drawings, there is shown a rocket launcher 10 in a preferred form of the invention. The rocket launcher 10 has a manual air pump 11 coupled to a base unit 12 through an elongated pressure tube 13. The air pump 11 includes a conventional cylinder 16, a cylinder rod or plunger 17 and a handle 18 mounted to an end of the cylinder rod 17. A pressure release valve or trigger 20 is coupled to the pressure tube 13 between the pump 11 and the base unit 12.

The base unit 12 has a housing 23 forming a pressure chamber 24 and a launch tube 25 extending from and in fluid communication with the pressure chamber 24. The launch tube 25 has an opening 26 in the top end thereof. The launch tube is sized and shaped to be received within the bore 28 of a conventional compressed air rocket 29. The base unit 12 also has an orientation sensitive safety mechanism 32 coupled to the end of the pressure tube 13. The safety mechanism 32 is also coupled to an internal pressure tube 33 extending to a pressure sensitive release valve 34 which controls the release of pressurized air through the launch tube opening 26. The pressure sensitive release valve 34 has a cylindrical manifold 35 and a plunger 36 mounted therein for movement between a sealing position sealing the launch tube opening 26 and a unsealing position spaced from the launch tube opening 26 to allow the flow of pressurized air through launch tube opening 26.

The orientation sensitive safety mechanism 32 has an air inlet 39 in fluid communication with a control valve 40 which in turn is in fluid communication with the lower end of the internal pressure tube 33. The control valve 40 has a cylindrical manifold 41 and a snap action piston 42 slidably mounted within the manifold 41. This type of snap action piston is described in detail in U.S. patent application Ser. No. 09/175,107, which is specifically incorporated herein. The manifold 41 has an air outlet 43 to ambience and a conduit or passage 44 extending to the internal pressure tube 33. The snap action piston 42 has a sealing gasket 46 sized and shaped to seal the air outlet 43 with the piston in a sealing position and unsealing the air outlet 43 with the piston in a retracted, unsealing position which opens the internal pressure tube 33 to ambience through passage 44 and air outlet 43. The safety mechanism 32 also has ball chamber 48 in fluid communication with the air inlet 39 through an opening 49 in a gradually sloped, inverted cone-shaped chamber floor 50. The safety mechanism 32 is also in fluid communication with the pressure chamber 24 through a conduit or passage 52. A movable ball 53, sized and shaped to seat partially within and seal the floor opening 49 is positioned within ball chamber 48.

In use, an operator actuates the air pump 11 by reciprocating the pump cylinder rod 17 through the cylinder 16. The pressurized air created by this movement passes through the release valve 20, through the pressure tube 13 and into the safety mechanism 32 through air inlet 39. With the launch tube 25 oriented in a generally vertical orientation the safety mechanism ball 53 resides partially within floor opening 49 thereby allowing the passage of incoming pressurized air past the ball 53 and into the ball chamber 48, and through passage 52 into the pressure chamber 24 and launch tube 25. The pressurized air within the pressure chamber 24 is prevented from flowing back in an opposite direction by the sealed engagement of the ball 53 within the floor opening 49. A portion of the pressurized air also passes between the snap action piston 42 and surrounding manifold 41, and through the passage 44 into the internal pressure tube 33. The pressurized air within the internal pressure tube 33 forces the pressure sensitive release valve plunger 36 upwards into a sealing position closing launch tube top opening 26.

Figure 3:
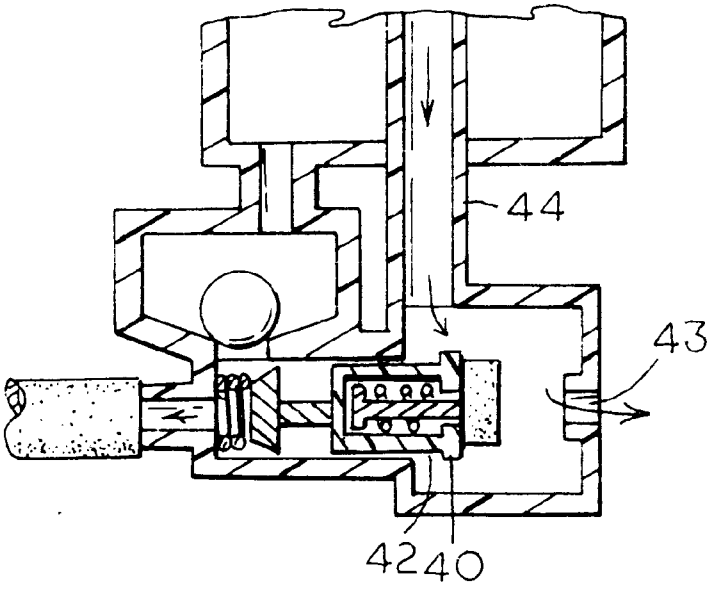
FIG. 3 is an enlarged side view of the safety mechanism of the rocket launcher shown in FIG. 1, shown in a vertical launching phase.
Figure 2:
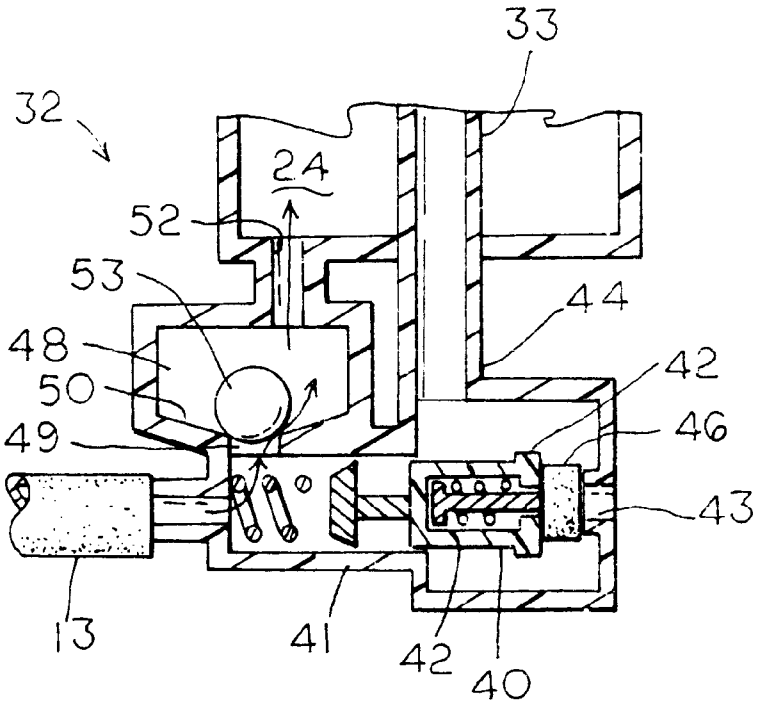
FIG. 2 is an enlarged side view of the safety mechanism of the rocket launcher shown in FIG. 1, shown in a pressurizing phase.

As shown in FIG. 3, once the pressure chamber 24 is fully pressurized the operator may initiate the firing of the launcher by the actuation of the release valve 20. The actuation of the release valve 20 opens pressure tube 13 to ambience, thereby causing a drop in pressure within the pressure tube 13 and adjoining safety mechanism 32. With the launch tube 25 oriented generally vertical the safety mechanism ball 53 is sealably seated within floor opening 49. As such, the drop in air pressure causes the snap action piston 42 to move quickly to its unsealing position unsealing opening 43. With opening 43 unsealed, the pressurized air within the internal pressure tube 33 is released to ambience thereby causing the pressure sensitive release valve plunger 36 to move to its unsealing position allowing the pressurized air within the pressure chamber 24 and launch tube 25 to be released through launch tube top opening 26 and into the bore 28 of the rocket 29. This release of pressurized air through top opening 26 causes the rocket mounted upon the launch tube to be propelled into the air.

Figure 4:
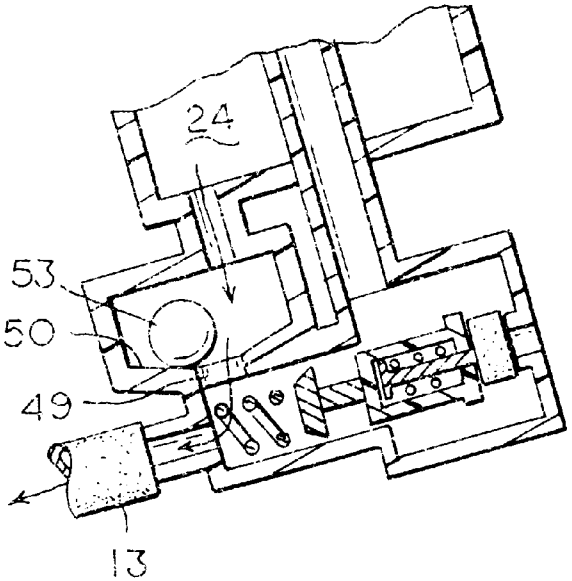
FIG. 4 is an enlarged side view of the safety mechanism of the rocket launcher shown in FIG. 1, shown in a vertically offset, non-launching phase.

As shown in FIG. 4, should the launch tube 25 be oriented in a position offset from the vertical the ball 53 within ball chamber 48 becomes unseated from opening 49. With the ball in this position the actuation of the pressure release valve 20 opens the pressure chamber 24 and launch tube 25 to ambience, thereby causing pressurized air within the pressure chamber 24 and launch tube 25 to pass through the passage 52, the ball chamber 48, the floor opening 49, the air inlet 39 and the pressure tube 13 to ambience. This release of the pressurized air to ambience not only prevents the firing of the launcher but also depressurizes the pressure chamber and launch tube so that the rocket launcher can not be fired in another manner. The decompression of the rocket launcher eliminates the dangers associated with fracturing the pressure chamber while under pressure and the possible harm this may occur.

As shown herein, the launch tube 25 acts as a portion of the pressure chamber 24. However, it should be understood that the launch tube may be constructed as a separate portion from the pressure chamber, with the pressure sensitive release valve positioned between the launch tube and the pressure chamber, as shown in U.S. Pat. No. 5,653,216. Furthermore, the pressure chamber may be incorporated entirely within the launch tube, i.e. the launch tube may comprise the entire pressure chamber. As such, the terms launch tube and pressure chamber, as used herein, may refer to a single item or a combination of items.

Figure 5:
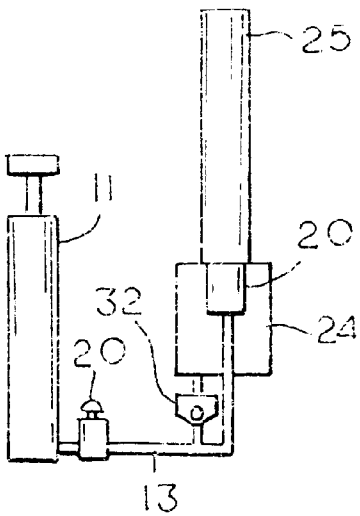
FIG. 5 is a schematic view of a rocket launcher in another preferred embodiment.

Referring next to FIG. 5, there is shown a rocket launcher 60 in another preferred embodiment. Here, the rocket launcher 60 is essentially the same as that previously described except for the elimination of the control valve 40. The control valve 40 is necessary wherein there is a long pressure tube 13 between the pump 11 and pressure sensitive release valve 34 because a long pressure tube causes a slow release of air from therein. The slow release of air prevents the rapid movement of the pressure sensitive release valve, which in turn causes a slow discharge of pressurized air into the rocket. For this reason, the control valve 40 is added to a long pressure tube so that there is a controlled release of pressurized air by the control valve immediately behind the pressure sensitive release valve, thereby insuring a quick actuation of the pressure sensitive release valve and a rapid discharge of pressurized air from the launch tube.

Figure 6:
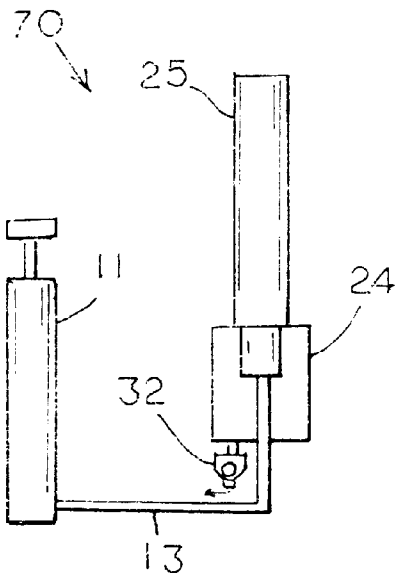
FIG. 6 is a schematic view of a rocket launcher in yet another preferred embodiment.

Referring next to FIG. 6, there is shown a rocket launcher 70 in yet another preferred embodiment. Here, the rocket launcher 70 is essentially the same as that shown in FIG. 5 except that the safety mechanism 32 is not in direct fluid communication with the pressure tube, but instead is vented directly to ambience. As such, should the ball become unseated from the floor opening at any time there will be an immediate release of pressurized air from the pressure chamber to ambience. This is different from the previously shown embodiments which maintain pressurization should the ball become unseated but which depressurize the pressure chamber to ambience only upon the actuation of the release valve and the ball being unseated.

It should be understood that the term rocket, as used herein, refers to any type of projectile which may be launched from a compressed air launcher of the described herein. It should also be understood that the just described invention may also include launch tubes in which a projectile is inserted rather than the projectile being mounted upon the launch tube, such a foam darts, balls, arrows, rockets and the like.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

What is claimed is:

1. A rocket launcher comprising:

an air pump;

a pressure cell;

a first conduit in fluid communication with said pump and said pressure cell;

a launch tube in fluid communication with said pressure cell through a release valve;

a trigger operatively coupled with said release valve; and an orientation sensitive check valve in fluid communication with said pressure cell which releases air from said pressure cell should the launch tube be oriented at an offset position from a generally vertical orientation, said orientation sensitive check valve comprises a housing having a floor with an opening therein and a ball positioned within said housing sized and shaped to seal said opening when positioned at least partially within said opening, whereby with the launch tube in a generally vertical position the orientation sensitive check valve prevents air from flowing from the pressure cell to ambience thereby allowing the actuation of the release valve and the release of pressurized air into the launch tube with the actuation of the trigger, and whereby with the launch tube in an offset position the orientation sensitive check valve vents pressurized air within the pressure cell to ambience thereby decompressing the pressure cell and preventing the release of pressurized air into the launch tube.

2. The rocket launcher of claim 1 wherein said release valve is a pressure sensitive release valve and wherein said trigger is a pressure release valve.

3. The rocket launcher of claim 2 further comprising a second pressure sensitive release valve coupled to said first conduit, whereby the actuation of the pressure release valve causes the actuation of the second pressure sensitive release valve, which in turn causes the actuation of the pressure sensitive release valve.

4. The rocket launcher of claim 1 wherein said orientation sensitive check valve includes a second conduit in fluid communication with said first conduit.

5. The rocket launcher of claim 4 further comprising a second pressure sensitive release valve coupled to said first conduit, whereby the actuation of the pressure release valve causes the actuation of the second pressure sensitive release valve, which in turn causes the actuation of the first pressure sensitive release valve.

6. The rocket launcher of claim 1 wherein said launch tube forms at least a portion of said pressure cell.

7. A rocket launcher comprising:

an air pump for providing a supply of pressurized air;

a pressure cell in fluid communication with said pump through conduit means;

a launch tube in fluid communication with said pressure cell through a first pressure sensitive release valve;

said conduit means having a first conduit extending between said pump and said first pressure sensitive release valve and a second conduit in fluid communication with said first conduit and said pressure cell, said second conduit having an orientation sensitive check valve means for preventing the flow of air from said pressure cell to said first conduit when said launch tube is oriented in a generally vertical position and for allowing the flow of air from said pressure cell to said first conduit when said launch tube is offset from a generally vertical position, said orientation sensitive check valve means includes a housing having a floor with an opening therein and a ball positioned within said housing sized and shaped to pneumatically seal said opening when positioned at least partially within said opening. and a pressure release valve coupled to said first conduit, whereby with the launch tube in a generally vertical position the orientation sensitive check valve means prevents air from flowing from the pressure cell into the first conduit with the actuation of the pressure release valve, thereby causing the actuation of the first pressure sensitive release valve and the release of pressurized air into the launch tube, and whereby with the launch tube in an offset position the orientation sensitive check valve means allows the flow of air from the pressure cell into the first conduit means with the actuation of the pressure release valve thereby decompressing the pressure cell and preventing the release of pressurized air into the launch tube.

8. The rocket launcher of claim 7 further comprising a second pressure sensitive release valve coupled to said first conduit, whereby the actuation of the pressure release valve causes the actuation of the second pressure sensitive release valve, which in turn causes the actuation of the first pressure sensitive release valve.

9. The rocket launcher of claim 7 wherein said launch tube forms at least a portion of said pressure cell.

10. A rocket launcher comprising:

an air pump;

a pressure cell in fluid communication with said pump through a first conduit;

a launch tube in fluid communication with said pressure cell;

a first pressure sensitive release valve in fluid communication with said first conduit, said first pressure sensitive release valve controlling the release of pressurized air from said pressure cell to said launch tube;

an orientation sensitive check valve in fluid communication with said pressure cell for preventing the flow of air from said pressure cell to ambience when said launch tube is oriented in a generally vertical position and for allowing the flow of air from said pressure cell to ambience when said launch tube is offset from a generally vertical position, said orientation sensitive check valve having a housing having a floor with an opening therein and a ball positioned within said housing sized and shaped to seal said opening when positioned at least partially within said opening, and a pressure release valve coupled to said first conduit, whereby with the launch tube in a generally vertical position the orientation sensitive check valve prevents air from flowing from the pressure cell to ambience thereby allowing the actuation of the first pressure sensitive release valve and the release of pressurized air into the launch tube with the actuation of the pressure release valve, and whereby with the launch tube in an offset position the orientation sensitive check valve vents pressurized air within the pressure cell to ambience thereby decompressing the pressure cell and preventing the firing of the launcher.

11. The rocket launcher of claim 10 further comprising a second pressure sensitive release valve coupled to said first conduit, whereby the actuation of the pressure release valve causes the actuation of the second pressure sensitive release valve, which in turn causes the actuation of the first pressure sensitive release valve.

12. The rocket launcher of claim 10 wherein said orientation sensitive check valve comprises a housing having a floor with an opening therein and a ball positioned within said housing sized and shaped to seal said opening when positioned at least partially within said opening.

13. The rocket launcher of claim 12 further comprising a second pressure sensitive release valve coupled to said first conduit, whereby the actuation of the pressure release valve causes the actuation of the second pressure sensitive release valve, which in turn causes the actuation of the first pressure sensitive release valve.

14. The rocket launcher of claim 10 wherein said launch tube forms at least a portion of said pressure cell.

* * * * *